US007453410B2

(12) United States Patent
Chang

(10) Patent No.: US 7,453,410 B2
(45) Date of Patent: Nov. 18, 2008

(54) WAVEGUIDE ANTENNA USING A CONTINUOUS LOOP WAVEGUIDE FEED AND METHOD OF PROPAGATING ELECTROMAGNETIC WAVES

(75) Inventor: Yu-Wen Chang, Rancho Palos Verdes, CA (US)

(73) Assignee: Chang Indusatry, Inc., La Verne, CA (US)

( * ) Notice: Subject to any disclaimer, the term of this patent is extended or adjusted under 35 U.S.C. 154(b) by 193 days.

(21) Appl. No.: 11/401,513

(22) Filed: Apr. 11, 2006

(65) Prior Publication Data

US 2007/0236402 A1 Oct. 11, 2007

(51) Int. Cl.
*H01Q 13/06* (2006.01)
*H01P 5/22* (2006.01)

(52) U.S. Cl. ..... 343/776; 333/120; 333/137

(58) Field of Classification Search ..... 333/120, 333/125, 137; 343/776, 852
See application file for complete search history.

(56) References Cited

U.S. PATENT DOCUMENTS 2,784,381 A * 3/1957 Budenbom ..... 333/120
3,189,848 A * 6/1965 Miyagi ..... 333/120
4,093,928 A 6/1978 Proctor
4,316,160 A * 2/1982 Dydyk ..... 333/120
4,419,635 A 12/1983 Reindel
4,420,839 A 12/1983 Hogerheiden, Jr.
4,839,659 A 6/1989 Stern et al.
4,904,966 A 2/1990 Rubin
6,621,468 B2 * 9/2003 Kanamaluru ..... 343/853
6,803,838 B2 10/2004 Hoyland
6,943,744 B1 9/2005 Vezmar
2003/0060182 A1 3/2003 Nibe
2004/0108903 A1 6/2004 Channabasappa et al.

OTHER PUBLICATIONS

Franz X. Sinnesbichler; *Hybrid Millimeter-Wave Push-Push Oscillators Using Silicon-Germanium HBTs*; IEEE Translations on Microwave Theory and Technologies; Feb. 2003; pp. 422-430; vol. 51, No. 2; IEEE 2003.
Maurico Sanchez Barbetty; *Design and Implementation of a Transceiver and a Microstrip Corporate Feed for Solid State X-Band Radar*; 2005; 58 pages (29 condensed pages).

* cited by examiner

*Primary Examiner*—Benny Lee
(74) *Attorney, Agent, or Firm*—Alston & Bird LLP

(57) ABSTRACT

An antenna includes first, second and third waveguides in direct communication with a base waveguide at first, second and third positions, respectively, the base waveguide forming a continuous loop. The second position, at which the second waveguide is in direct communication with the base waveguide, is spaced apart from the first position by about one-sixth the circumference of the loop. The third position, at which the third waveguide is in direct communication with the base waveguide, is spaced apart from the first position by about one-sixth the circumference of the loop, and is uninterruptedly spaced apart from the second position, without extending through the first position, by about two-thirds the circumference of the loop. The first, second and third waveguides comprise closed-channel waveguides, and the second and third waveguides have an open end and are configured to radiate electromagnetic waves and/or focus radiating electromagnetic waves.

18 Claims, 6 Drawing Sheets

WAVEGUIDE ANTENNA USING A CONTINUOUS LOOP WAVEGUIDE FEED AND METHOD OF PROPAGATING ELECTROMAGNETIC WAVES

FIELD OF THE INVENTION

Exemplary embodiments of the present invention generally relate to antennas and methods for radiating and/or focusing electromagnetic waves and, more particularly, relate to phased-array antennas configured to radiate and/or focus electromagnetic waves in the millimeter-wave region of the electromagnetic spectrum.

BACKGROUND OF THE INVENTION

In a number of different industries, antennas are utilized to transmit and/or receive electromagnetic waves, such as those commonly referred to as radio waves. As is well known, an antenna is generally an arrangement of conductors designed to radiate electromagnetic waves, and/or due to the reciprocity property, focus a radiating electromagnetic wave. Although antennas may be utilized in a number of different contexts, antennas in one common context are utilized in communication systems to transmit and/or receive radio frequency signals. To transmit radio frequency signals in such instances, the radio frequency signals may be formed from alternating currents that drive the antenna to radiate electromagnetic waves representative of those currents. And to receive radio frequency signals, radiating electromagnetic waves focused by the antenna may induce alternating voltages/currents that may form radio frequency signals.

Different types of antennas in use today include, for example, dipole antennas, microstrip antennas, loop antennas and open-ended waveguide antennas. Also, for example, a number of different types of antennas can be arranged and configured to form additional types of antennas, one of which is the array antenna. In this regard, an array antenna is generally an antenna including a number of conductors arranged in a spaced apart relationship with one another, such as collinearly in one dimension to thereby form a linear array antenna, or collinearly and in parallel in two dimensions to thereby form a planar array. Further within the context of array antennas, the relative phases and amplitudes of the alternating currents driving the conductors may be varied to thereby shape and direct the electromagnetic waves radiated thereby. Antennas configured in this manner are commonly referred to as phased-array antennas. And although a number of antenna configurations have been designed, it is generally desirable to improve upon existing designs.

SUMMARY OF THE INVENTION

In view of the foregoing background, exemplary embodiments of the present invention provide an improved antenna and method of propagating electromagnetic waves. The antenna of exemplary embodiments of the present invention includes a number of close-channel waveguides, and as such, may reduce propagation loss at millimeter wave frequencies (e.g., above 30 GHz), as compared to other waveguiding structures such as microstrip and stripline structures. Also due to the closed-channel configuration, the antenna of exemplary embodiments of the present invention may be "sealed" against environmental damage, which may otherwise affect microstrip and stripline structures. The antenna of exemplary embodiments of the present invention may also have a cutoff frequency range that cuts off at least some jamming and interference signals below the millimeter wave frequencies for which the antenna is designed. In addition, the antenna of exemplary embodiments of the present invention may require a substantially smaller footprint when compared with circuits, such as rat-race circuits, having one or more waveguides with similar configurations.

According to one aspect of exemplary embodiments of the present invention, and antenna is provided. The antenna includes first, second and third waveguides in direct communication with a base waveguide at first, second and third positions, respectively, the base waveguide forming a continuous loop. The second position, at which the second waveguide is in direct communication with the base waveguide, is spaced apart from the first position by about one-sixth the circumference of the loop. The third position, at which the third waveguide is in direct communication with the base waveguide, is spaced apart from the first position by about one-sixth the circumference of the loop, and is uninterruptedly spaced apart from the second position, without extending through the first position, by about two-thirds the circumference of the loop. The first, second and third waveguides comprise closed-channel waveguides, and the second and third waveguides have an open end and are configured to radiate electromagnetic waves and/or focus radiating electromagnetic waves, such as those having a wavelength in the millimeter-wave region of the electromagnetic spectrum.

The first waveguide may comprise a transmitting waveguide for propagating electromagnetic waves to be radiated by the second and third waveguides. The antenna may further include a fourth waveguide in direct communication with the base waveguide at a fourth position spaced apart from the first position by about one-third the circumference of the loop. In such instances, the fourth waveguide comprises a receiving waveguide for receiving radiated electromagnetic waves focused by the second and third waveguides. Further, the antenna may include an amplifier in communication with the first waveguide, and configured to at least partially reduce propagation, through the first waveguide, of radiated electromagnetic waves focused by the second and third waveguides.

According to a further aspect of exemplary embodiments of the present invention, an antenna comprises a plurality of waveguide assemblies. In such instances, the waveguide assemblies may be arranged such that the second and third waveguides of one or more waveguide assemblies are in direct communication with the first waveguides of a pair of other waveguide assemblies. In addition, the second and third waveguides of a plurality of the waveguide assemblies may have an open end and be configured to radiate electromagnetic waves and/or focus radiating electromagnetic waves, such as those in the millimeter-wave region of the electromagnetic spectrum.

More particularly, the plurality of waveguide assemblies may be collinearly arranged into a plurality of layers to thereby define a linear array (e.g., one-dimensional linear array), where the layers include at least a first layer and a last layer. The second and third waveguides of the waveguide assemblies of each layer other than the last layer may be in direct communication with the first waveguides of a pair of waveguide assemblies of a next layer. The second and third waveguides of the waveguide assemblies of the last layer, then, may have the open end and are configured to radiate electromagnetic waves and/or focus radiating electromagnetic waves. The antenna may include a plurality of linear arrays to thereby define a two-dimensional linear array. In such instances, the antenna may further include one or more additional waveguide assemblies, the second and third waveguides of at least one of which may be in direct communication with the first waveguides of the first layer waveguide assemblies of a pair of linear arrays.

The antenna may additionally or alternatively have a directional array configuration such that, for at least the last layer, the second waveguide of one or more waveguide assemblies has a length greater than a length of the second waveguide of one or more other waveguide assemblies, and similarly, the third waveguide of one or more waveguide assemblies has a length greater than a length of the third waveguide of one or more other waveguide assemblies.

According to other aspects of the present invention, a method is provided for propagating an electromagnetic wave. As indicated above and explained below, the antenna and method of exemplary embodiments of the present invention may solve the problems identified by prior techniques and may provide additional benefits.

BRIEF DESCRIPTION OF THE DRAWINGS

Figure 1:
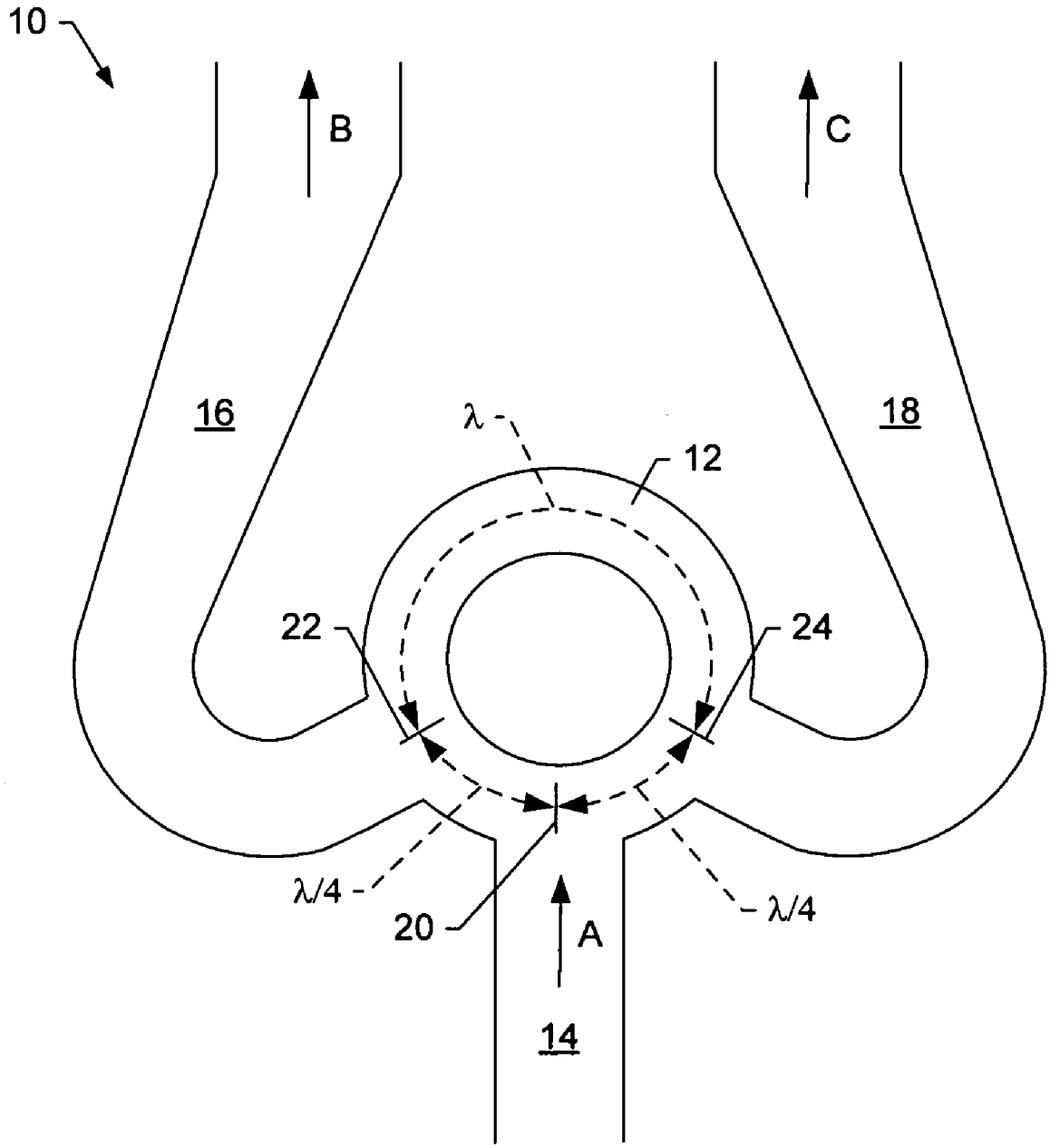
Figure 2:
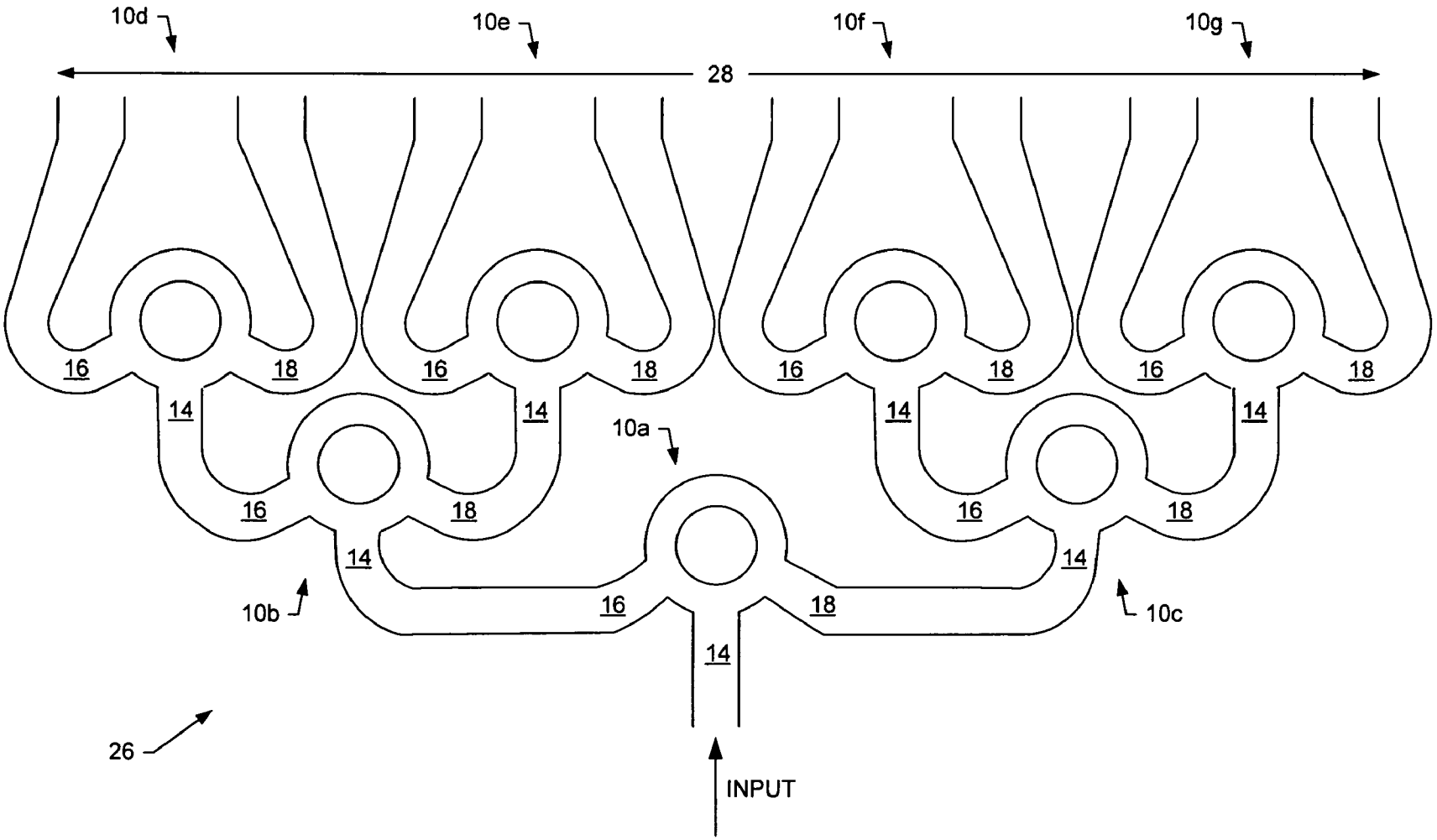
Figure 3:
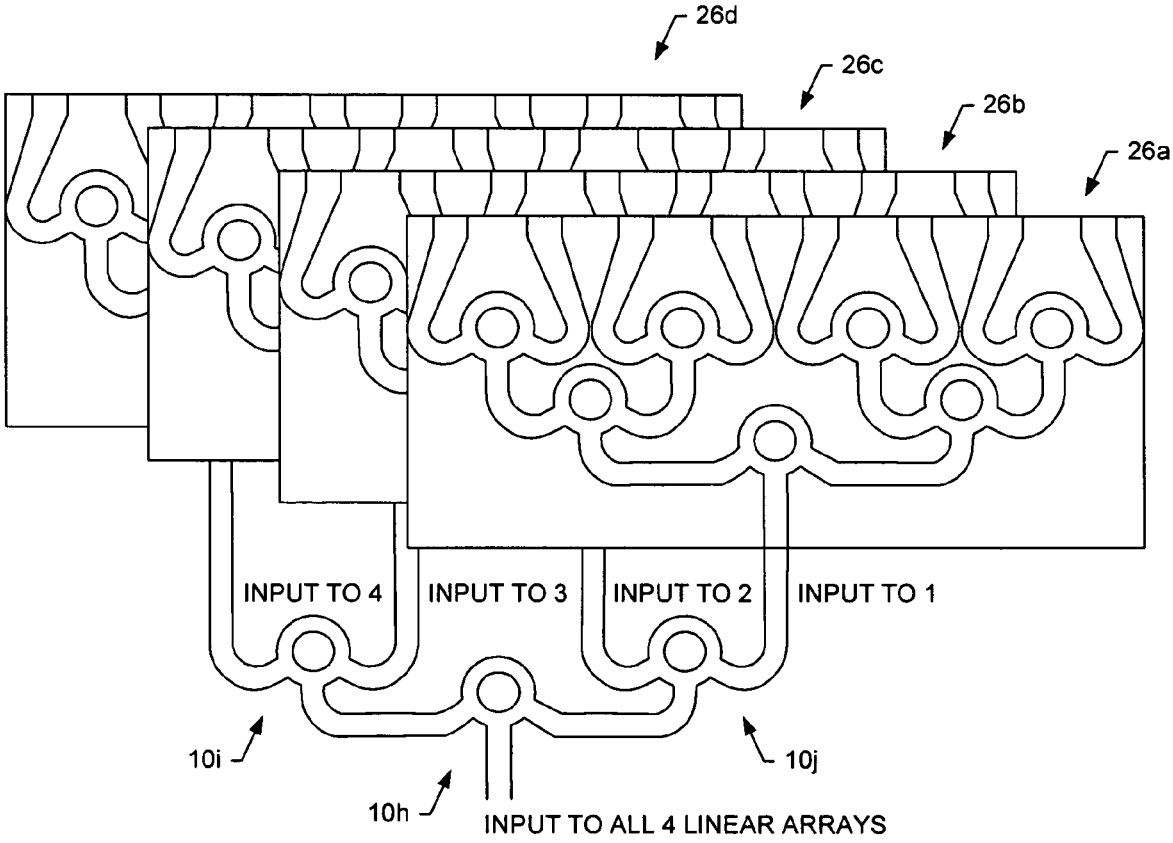
Figure 4:
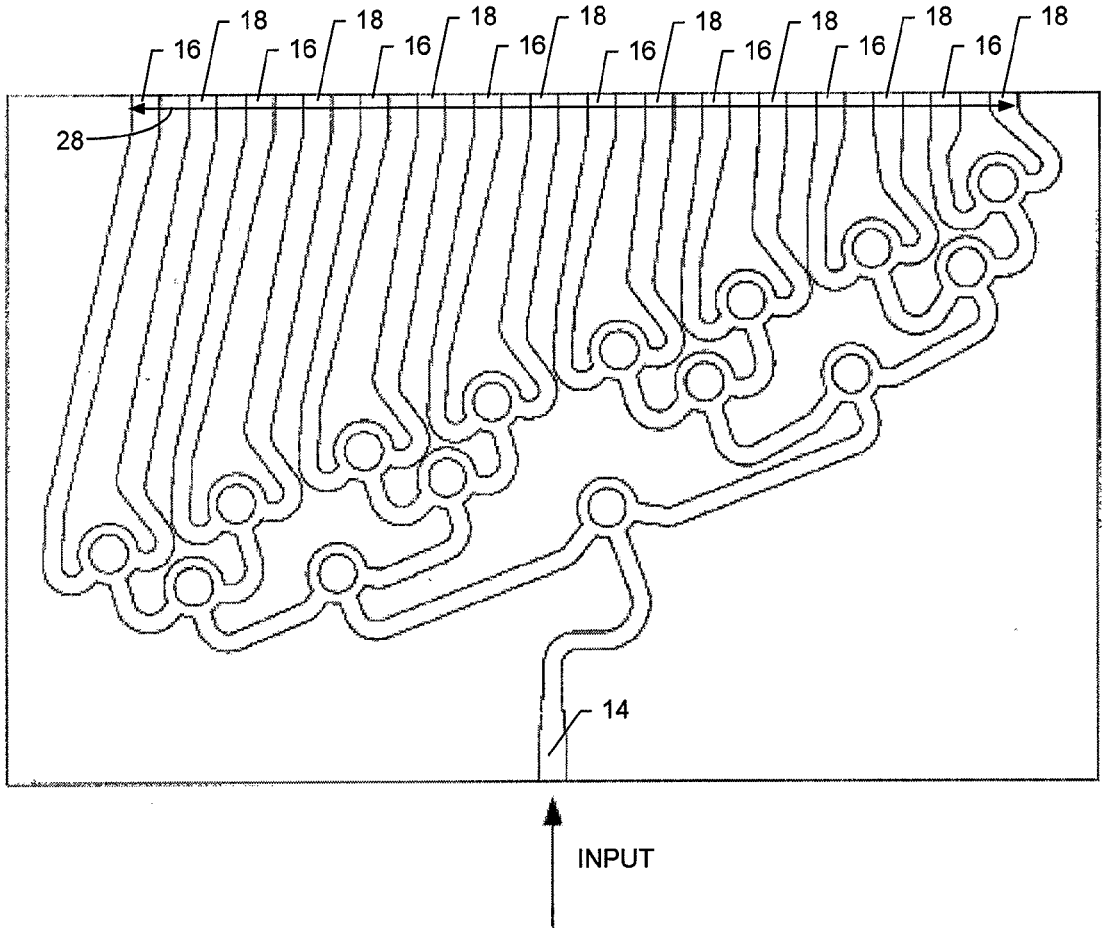
Figure 5:
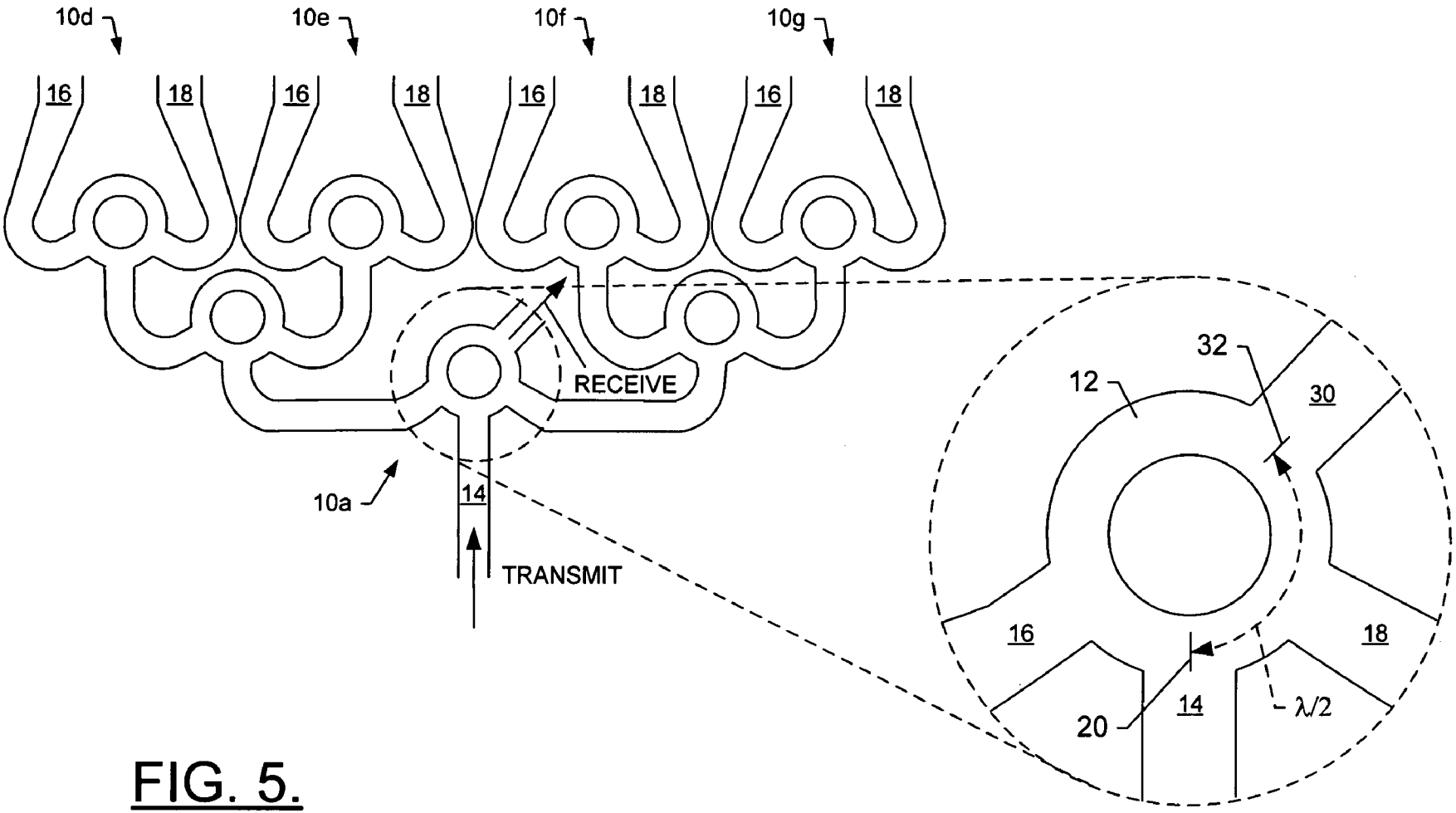
Figure 6:
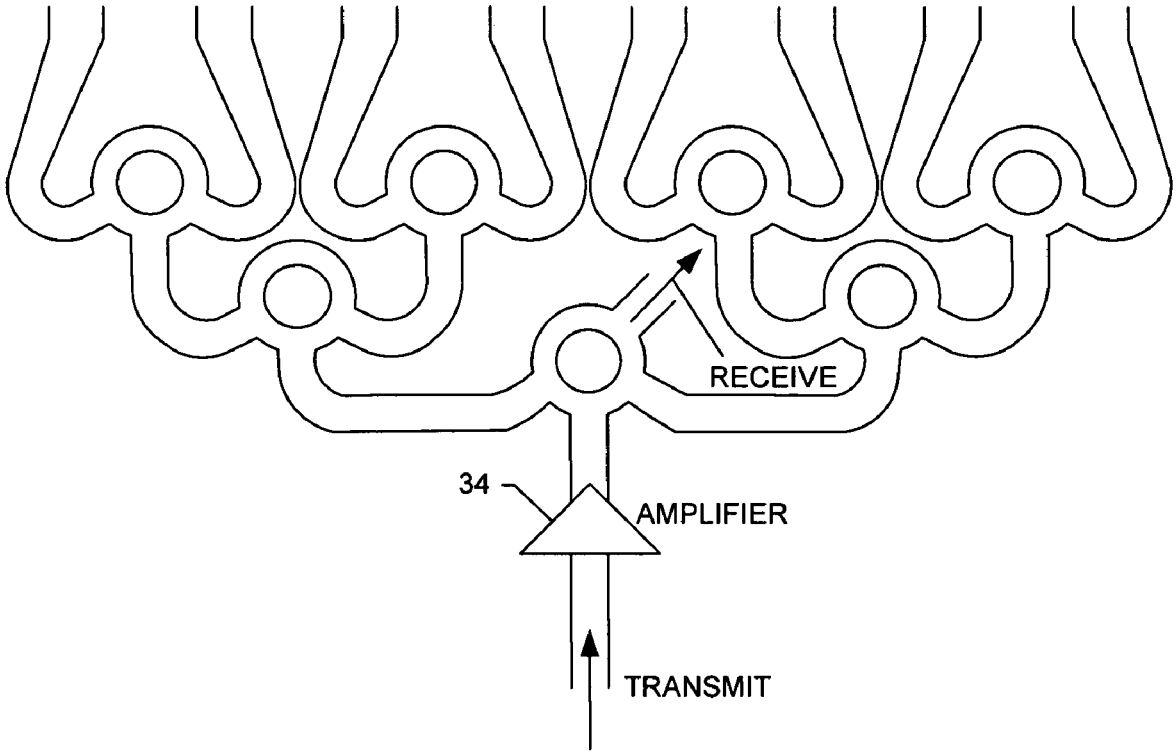

Having thus described the invention in general terms, reference will now be made to the accompanying drawings, which are not necessarily drawn to scale, and wherein:

FIG. 1 is a schematic illustration of an antenna including a waveguide assembly, in accordance with one exemplary embodiment of the present invention;

FIG. 2 is a schematic illustration of an antenna including a plurality of waveguide assemblies, configured as a one-dimensional linear array, in accordance with one exemplary embodiment of the present invention;

FIG. 3 is a schematic illustration of an antenna including a plurality of waveguide assemblies, configured as a two-dimensional linear array, in accordance with one exemplary embodiment of the present invention;

FIG. 4 is a schematic illustration of an antenna including a plurality of waveguide assemblies, configured as a directional linear array, in accordance with one exemplary embodiment of the present invention;

FIG. 5 is a schematic illustration of an antenna including a plurality of waveguide assemblies, configured in a manner including transmitting and receiving waveguides, in accordance with one exemplary embodiment of the present invention; and FIG. 6 is a schematic illustration of the antenna of FIG. 5, further including an amplifier at the transmitting waveguide, in accordance with one exemplary embodiment of the present invention.

DETAILED DESCRIPTION OF THE INVENTION

The present invention now will be described more fully hereinafter with reference to the accompanying drawings, in which some, but not all embodiments of the invention are shown. Indeed, the invention may be embodied in many different forms and should not be construed as limited to the embodiments set forth herein; rather, these embodiments are provided so that this disclosure will satisfy applicable legal requirements. Like numbers refer to like elements throughout.

As shown in FIG. 1, an antenna according to one exemplary embodiment of the present invention includes one or more waveguide assemblies 10 (one being shown in FIG. 1). The waveguide assembly includes a base waveguide 12 forming a continuous loop, and first, second and third waveguides 14, 16, 18, in direct communication with the base waveguide at first, second and third positions 20, 22, 24, respectively. The first, second and third waveguides comprise closed-channel waveguides, and the second and third waveguides have an open end and are configured to radiate electromagnetic waves and/or focus radiating electromagnetic waves, such as those having a wavelength in the millimeter-wave region of the electromagnetic spectrum, during operation of the antenna. In this regard, the first waveguide can comprise a transmitting waveguide for propagating electromagnetic waves to be radiated by the second and third waveguides.

As shown, the first and second positions 20, 22 are spaced apart from one another by about ⅙ the circumference of the loop formed by the base waveguide 12. Similarly, the first and third positions 20, 24 are spaced apart from one another by about ⅙ the circumference of the loop. The second and third positions, then, are uninterruptedly spaced apart from one another by about ⅔ the circumference of the loop, without extending through the first position. As shown, the antenna is configured such that electromagnetic waves propagating therein have a wavelength $\lambda$ that is about ⅔ the circumference of the loop, or rather the circumference of the loop is about $3/2\lambda$. In terms of the wavelength of the electromagnetic waves propagating through the antenna, then, the first and second positions, and the first and third positions, are spaced apart from one another by about $\lambda/4$. And the second and third positions are spaced apart from one another by about $\lambda$.

Operation of the antenna shown in FIG. 1 will now be briefly described with reference to transmitting electromagnetic waves, the second and third waveguides 22, 24 in such an instance radiating electromagnetic waves. It should be understood, however, that due to the reciprocity property, the antenna may similarly operate to receive electromagnetic waves, with the second and third waveguides in such an instance focusing radiating electromagnetic waves. A further configuration for duplex operation (i.e., transmitting and receiving electromagnetic waves) will be described below with reference to FIGS. 5 and 6.

In operation, electromagnetic waves input into the first waveguide 14 (designated at A in FIG. 1) propagate therethrough and into the second waveguide 16 (designated at B) via two paths, a clockwise path and a counterclockwise path. The clockwise path from the first position 20 to the second position 22 has a path length about $\lambda/4$, which is equivalent to a phase of 90°. The counterclockwise path from the first position to the second position through the third position 24, on the other hand, has a path length of about $5\lambda/4$ (i.e., $\lambda/4+\lambda$), which is also equivalent to 90° (360°+90° being equivalent to 90°). As such, the clockwise and counterclockwise paths have approximately same phase values and the two waves "add." The waveguide assembly 10 shown in FIG. 1 may therefore operate in a manner similar to a rat-race circuit. Similarly, electromagnetic waves input into the first waveguide propagate therethrough and into the third waveguide (designated at C) via a clockwise path and a counterclockwise path that also add.

Due to the symmetry between the first and second waveguides 14, 16, and the first and third waveguides 14, 18, electromagnetic waves input into the first waveguide may be equally, or about equally, divided between the second and third waveguides. As will be appreciated, however, some power from the third waveguide may be reflected into the second waveguide and vice versa, also via clockwise and counterclockwise paths. Any reflected power from the third waveguide to the second waveguide (and similarly from the second waveguide to the third waveguide) has a clockwise length about $\lambda/2$ (i.e., $\lambda/4+\lambda/4$) and a phase of 180°. Also, reflected power from the third waveguide to the second waveguide (and similarly from the second waveguide to the third waveguide) has a counterclockwise path length about λ(i.e., (λ/4+3λ/4) and a phase of 360°. As the reflected electromagnetic waves from the two paths have a phase difference of about 180°, the reflected electromagnetic waves substantially cancel one another. Therefore, reflected electromagnetic waves from the third waveguide will be substantially low, if in existence at all, at the second waveguide, and vice versa.

As indicated above, the waveguide assembly 10 shown in FIG. 1 may operate in a manner similar to a rat-race circuit. In contrast to a conventional rat-race circuit, however, the waveguide assembly of FIG. 1 does not include a terminal between the second and third waveguides 16, 18 for absorbing any power that may otherwise reflect from the second and/or third waveguides back to the first waveguide 14. As a result, the waveguide assembly of FIG. 1 may reflect more power back to the first waveguide as compared to a conventional rat-race circuit. Also as a result of not including an additional terminal, the waveguide assembly may be made smaller than a conventional rat-race circuit, thereby enabling the creation of a number of antenna assemblies with a useful size. For example, the waveguide assembly of FIG. 1 may be made with a footprint of 0.2"×0.2" at a frequency of about 60 GHz, while a conventional rat-race circuit may require a footprint of at least 0.24"×0.3" depending on how effective the waveguide terminal of such a circuit can absorb wave propagation without reflection. Further, in a number of conventional rat-race circuits, one may have to place electromagnetic (EM) wave absorbing material in the waveguide terminal, which may elongate the terminal to much larger than 0.3".

As shown in FIGS. 2-6, the waveguide assembly 10 of FIG. 1 may be configured in a number of different manners, alone or in combination with other waveguide assemblies, to form a number of different antennas. As shown in FIG. 2, for example, the antenna of another exemplary embodiment of the present invention includes a plurality of waveguide assemblies, seven of which (assemblies 10*a*, 10*b*, 10*c*, 10*d*, 10*e*, 10*f* and 10*g*) being shown for purposes of example. In this regard, the waveguide assemblies may be arranged such that the second and third waveguides 16, 18 of one or more of the waveguide assemblies are in direct communication with the first waveguides 14 of a pair of other waveguide assemblies. In other terms, the waveguide assemblies may be collinearly arranged into a plurality of layers, including at least a first layer and a last layer, to thereby define a linear array 26. The second and third waveguides of the waveguide assemblies of each layer other than the last layer may be in direct communication with the first waveguides of a pair of waveguide assemblies of a next layer. Also in such a configuration, the second and third waveguides of a plurality of the waveguide assemblies, such as those of the last layer, have an open end and are configured to radiate electromagnetic waves and/or focus radiating electromagnetic waves, such as electromagnetic waves having a wavelength in the millimeter-wave region of the electromagnetic spectrum. In such instances, the first waveguide of one of the waveguide assemblies may comprise a transmitting waveguide for receiving the electromagnetic waves radiated by the second and third waveguides of a number of other waveguide assemblies.

As shown in FIG. 2, for example, waveguide assembly 10*a* may define the first layer of a linear array 26, with assemblies 10*b* and 10*c* defining the second layer, and assemblies 10*d*, 10*e*, 10*f* and 10*g* defining the third layer, which in the illustrated configuration is the last layer. The second and third waveguides of waveguide assembly 10*a*, then, may be in direct communication with the first waveguides of waveguide assemblies 10*b* and 10*c*. Similarly, for example, the second and third waveguides of waveguide assembly 10*b* may be in direct communication with the first waveguides of waveguide assemblies 10*d* and 10*e*, and the second and third waveguides of waveguide assembly 10*c* may be in direct communication with the first waveguides of waveguide assemblies 10*f* and 10*g*. The second and third waveguides of waveguide assemblies 10*d*, 10*e*, 10*f* and 10*g* (i.e., second and third waveguide assemblies of the last layer), then, may have an open end and be configured to radiate electromagnetic waves and/or focus radiating electromagnetic waves. In such instances, the first waveguide of waveguide assembly 10*a* may comprise a transmitting waveguide for receiving the electromagnetic waves radiated by the second and third waveguides of waveguide assemblies 10*d*, 10*e*, 10*f* and 10*g*.

As shown in FIG. 2, by staggering three layers of waveguide assemblies 10, a single input to the first waveguide 14 of assembly 10*a* can be approximately equally divided among eight outputs, those being the second and third waveguides 16 and 18 of assemblies 10*d*,10*e*, 10*f* and 10*g*. This antenna configuration may be considered a "linear phased array antenna," whereby the path length from the input to each of the outputs may be approximately, if not exactly, the same. Therefore, the outputs at the assemblies 10*d*, 10*e*, 10*f* and 10*g* may radiate approximately, if not exactly, the same power and phase so that in a direction perpendicular to the array length 28, the electromagnetic waves from the outputs may add to thereby create a "pencil" beam pattern. In the directions in and out of the paper, the beam width may be very broad to thereby generate a "fan-shaped beam" or "fan-beam" pattern. Because of reciprocity, the fan-beam array may be used for both transmitting and receiving.

If so desired, the waveguide assemblies may be configured into a plurality staggered of linear arrays 26 (including at least first and last layers), thereby forming a two-dimensional linear array. In such instances, the antenna may further include one or more additional waveguide assemblies. The second and third wave guides 16, 18 of one or more of the additional assemblies may be in direct communication with the first waveguides 14 of the first layer waveguide assemblies of a pair of linear arrays. In this configuration, the antenna beam width along the array length may be determined by the length 28 of the linear arrays; and the antenna beam width along the direction of the staggered array determined by the width of the staggered arrays. As shown in FIG. 3, for example, the waveguide assemblies may be configured into four linear arrays 26*a*, 26*b*, 26*c*and 26*d*. The antenna may then further include three additional waveguide assemblies 10*h*, 10*i* and 10*j*, where an input to additional waveguide assembly 10*h* may be divided among the four linear arrays via additional waveguide assemblies 10*i* and 10*j* (INPUT TO ALL 4 LINEAR ARRAYS). The second and third wave guides of additional assembly 10*j* may be in direct communication with the first waveguides of the first layer waveguide assemblies of linear arrays 26*a* (INPUT TO 1) and 26*b* (INPUT TO 2). Similarly, the second and third wave guides of additional assembly 10*i* may be in direct communication with the first waveguides of the first layer waveguide assemblies of linear arrays 26*c* (INPUT TO 3) and 26*d* (INPUT TO 4).

Additionally or alternatively, the waveguide assemblies 10 may be configured such that, for at least the last layer, the lengths of one or more of the second and/or third waveguides 16, 18 of at least the last layer of waveguide assemblies differ from one or more other second and/or third waveguides to thereby form a directional linear phased array antenna. More particularly, for at least the last layer, the second waveguide of one or more waveguide assemblies has a length greater than a length of the second waveguide of one or more other waveguide assembly. Similarly in such instances, for at least the last layer, the third waveguide of one or more waveguide assemblies has a length greater than a length of the third waveguide of one or more other waveguide assemblies. As shown in FIG. 4, in one typical configuration, at least the last layer may be configured such that the lengths of the second and third waveguides increase along the array length 28. In operation, the antenna of such a configuration may emit a beam of electromagnetic waves that points to the right instead of perpendicular to the array length.

As shown in FIGS. 5 and 6, and more particularly the inset of FIG. 5, the waveguide assembly of the first layer may further include a fourth waveguide 30 in direct communication with the respective base waveguide at a fourth position 32 spaced apart from the first position 20 by about ⅓ the circumference of the loop formed by the base waveguide 12 (i.e., ½λ). In such instances, the first waveguide 14 of the waveguide assembly 10*a* of the first layer may comprise a transmitting waveguide for propagating electromagnetic waves (TRANSMIT) to be radiated by the second and third waveguides 16, 18 of the waveguide assemblies 10*d*, 10*e*, 10*f* and 10*g* of the last layer. The fourth waveguide of the waveguide assembly of the first layer, then, may comprise a receiving waveguide for receiving radiated electromagnetic waves (RECEIVE) received by the antenna array via the second and third waveguides of the waveguide assemblies 10*d*, 10*e*, 10*f* and 10*g* of the last layer. Further, if so desired, the waveguide assembly of the first layer may include an amplifier 34 in communication with the first waveguide of the respective assembly, as shown in FIG. 6. In operation, the amplifier may be configured to at least partially reduce propagation, through the first waveguide of the waveguide assembly of the first layer, of radiated electromagnetic waves focused by the second and third waveguides of the waveguide assemblies of the last layer.

The antenna configuration of FIGS. 5 and 6 permits duplex operation to send and receive electromagnetic waves. In this regard, an input to the first waveguide 14 of the assembly of the first layer can be approximately equally divided among the second and third waveguides of the assemblies of the last layer, and output in the form of a fan-beam illuminating a target. Any return signals from the target, then, may be detected via the same fan-beam, propagating through waveguides of the assemblies of the last layer through the transmitting waveguide (e.g., first waveguide 14 of the first layer assembly) and the receiving waveguide (e.g., fourth waveguide 30 of the first layer assembly). The receiving waveguide may be configured to process the return signals. The return signals propagating through the transmitting waveguide, on the other hand, may be blocked by the amplifier 34. As will be appreciated, at least a portion of the return signals propagating through the transmitting waveguide may be reflected, although due to the phase cancellation effect, those reflected signals may not be detected by the receiving waveguide. Such a configuration may result in a radar transmitter-receiver coupled with the antenna without other transmit-receive isolation devices.

Many modifications and other embodiments of the invention set forth herein will come to mind to one skilled in the art to which the invention pertains having the benefit of the teachings presented in the foregoing descriptions and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. An antenna comprising:

a first waveguide in direct communication with a base waveguide at a first position, the base waveguide forming a continuous loop;

a second waveguide in direct communication with the base waveguide at a second position, the second position being spaced apart from the first position by about one-sixth the circumference of the loop; and a third waveguide in direct communication with the base waveguide at a third position opposite the first position from the second position, the third position being spaced apart from the first position by about one-sixth the circumference of the loop such that the third position is uninterruptedly spaced apart from the second position, without extending through the first position, by about two-thirds the circumference of the loop, wherein the first, second and third waveguides comprise closed-channel waveguides, and wherein the second and third waveguides have an open end and are configured to at least one of radiate electromagnetic waves or focus radiating electromagnetic waves.

2. An antenna according to claim 1, wherein the first waveguide comprises a transmitting waveguide for propagating electromagnetic waves to be radiated by the second and third waveguides.

3. An antenna according to claim 1, wherein the second and third waveguides are configured to at least one of radiate electromagnetic waves or focus radiating electromagnetic waves having a wavelength in the millimeter-wave region of the electromagnetic spectrum.

4. An antenna according to claim 1 further comprising:

a fourth waveguide in direct communication with the base waveguide at a fourth position, the fourth position being spaced apart from the first position by about one-third the circumference of the loop, wherein the first waveguide comprises a transmitting waveguide for propagating the electromagnetic waves to be radiated by the second and third waveguides, and wherein the fourth waveguide comprises a receiving waveguide for receiving radiated electromagnetic waves focused by the second and third waveguides.

5. An antenna according to claim 4 further comprising:

an amplifier in communication with the first waveguide, the amplifier being configured to at least partially reduce propagation, through the first waveguide, of radiated electromagnetic waves focused by the second and third waveguides.

6. An antenna comprising:

a plurality of waveguide assemblies, wherein each waveguide assembly comprises:

a base waveguide forming a continuous loop; and a first waveguide, a second waveguide and a third waveguide in direct communication with the base waveguide at a first position, a second position and a third position, respectively, wherein the first position is spaced apart from the second and third positions by about one-sixth the circumference of the loop, and the second position is uninterruptedly spaced apart from the third position by about two-thirds the circumference of the loop, wherein the first, second and third waveguides comprise closed-channel waveguides, wherein the plurality of waveguide assemblies are arranged such that the second and third waveguides of at least one waveguide assembly are in direct communication with the first wave guides of a pair of other waveguide assemblies, and wherein the second and third waveguides of a plurality of the waveguide assemblies have an open end and are configured to at least one of radiate electromagnetic waves or focus radiating electromagnetic waves.

7. An antenna according to claim 6, wherein the second and third waveguides of a plurality of the waveguide assemblies are configured to at least one of radiate electromagnetic waves or focus radiating electromagnetic waves having a wavelength in the millimeter-wave region of the electromagnetic spectrum.

8. An antenna according to claim 6, wherein the first waveguide of one of the waveguide assemblies comprises a transmitting waveguide for receiving the electromagnetic waves to be radiated by the second and third waveguides of a plurality of other waveguide assemblies.

9. An antenna according to claim 6, wherein the plurality of waveguide assemblies are collinearly arranged into a plurality of layers to thereby define a linear array, wherein the plurality of layers include at least a first layer and a last layer, wherein the second and third waveguides of the waveguide assemblies of each layer other than the last layer are in direct communication with the first waveguides of a pair of waveguide assemblies of a next layer, and wherein the second and third waveguides of the waveguide assemblies of the last layer have the open end and are configured to at least one of radiate electromagnetic waves or focus radiating electromagnetic waves.

10. An antenna according to claim 9 comprising a plurality of linear arrays, wherein the antenna further comprises at least one additional waveguide assembly, wherein the second and third waveguides of the at least one additional waveguide assembly are in direct communication with the first waveguides of the first layer waveguide assemblies of a pair of linear arrays.

11. An antenna according to claim 9, wherein, for at least the last layer, the second waveguide of at least one waveguide assembly has a length greater than a length of the second waveguide of at least one other waveguide assembly, and wherein, for at least the last layer, the third waveguide of at least one waveguide assembly has a length greater than a length of the third waveguide of at least one other waveguide assembly.

12. An antenna according to claim 9, wherein the waveguide assembly of the first layer further comprises a fourth waveguide in direct communication with a respective base waveguide at a fourth position spaced apart from the first position by about one-third the circumference of the loop, wherein the first waveguide of the waveguide assembly of the first layer comprises a transmitting waveguide for propagating electromagnetic waves to be radiated by the second and third waveguides of the waveguide assemblies of the last layer, and wherein the fourth waveguide of the waveguide assembly of the first layer comprises a receiving waveguide for receiving radiated electromagnetic waves focused by the second and third waveguides of the waveguide assemblies of the last layer.

13. An antenna according to claim 12, wherein the waveguide assembly of the first layer further comprises an amplifier in communication with the first waveguide of the waveguide assembly of the first layer, the amplifier being configured to at least partially reduce propagation, through the first waveguide, of radiated electromagnetic waves focused by the second and third waveguides of the waveguide assemblies of the last layer.

14. A method of propagating electromagnetic waves, the method comprising:

providing an antenna comprising:

a base waveguide forming a continuous loop; and a first waveguide, a second waveguide and a third waveguide in direct communication with the base waveguide at a first position, a second position and a third position, respectively, wherein the first position is spaced apart from the second and third positions by about one-sixth the circumference of the loop, and the second position is uninterruptedly spaced apart from the third position by about two-thirds the circumference of the loop, wherein the first, second and third waveguides comprise closed-channel waveguides; and propagating an electromagnetic wave through at least the base waveguide, and the second and third waveguides, the electromagnetic wave being radiated by the second and third waveguides, or comprising a radiated electromagnetic wave having been focused by the second and third waveguides.

15. A method according to claim 14, wherein the first waveguide comprises a transmitting waveguide, and wherein the propagating step comprises propagating the electromagnetic wave through the transmitting waveguide for radiation by the second and third waveguides.

16. A method according to claim 14, wherein the propagating step comprises propagating an electromagnetic wave having a wavelength in the millimeter-wave region of the electromagnetic spectrum.

17. A method according to claim 14, wherein the providing step comprises providing an antenna further comprising a fourth waveguide in direct communication with the base waveguide at a fourth position, the fourth position being spaced apart from the first position by about one-third the circumference of the loop, and wherein the propagating step comprises propagating the electromagnetic wave through the receiving waveguide, the electromagnetic wave comprising a radiated electromagnetic wave having been focused by the second and third waveguides.

18. A method according to claim 17, wherein the providing step comprises providing an antenna further comprising an amplifier in communication with the first waveguide, the amplifier being configured to at least partially reduce propagation, through the first waveguide, of radiated electromagnetic waves focused by the second and third waveguides.

* * * * *